US010988356B2

(12) United States Patent
G et al.

(10) Patent No.: US 10,988,356 B2
(45) Date of Patent: Apr. 27, 2021

(54) CONTROL UNIT FOR CONTROLLING A HOIST IN A LOAD SLIP CONDITION AND METHOD THEREOF

(71) Applicant: ABB Schweiz AG, Baden (CH)

(72) Inventors: Praveen G, Bangalore (IN); NS Prasad, Bangalore (IN)

(73) Assignee: ABB Schweiz AG, Baden (CH)

( * ) Notice: Subject to any disclaimer, the term of this patent is extended or adjusted under 35 U.S.C. 154(b) by 136 days.

(21) Appl. No.: 16/371,105

(22) Filed: Mar. 31, 2019

(65) Prior Publication Data

US 2019/0337778 A1 Nov. 7, 2019

(30) Foreign Application Priority Data

Mar. 31, 2018 (IN) ..... 201841012232

(51) Int. Cl.
*B66D 1/48* (2006.01)
*B66D 1/58* (2006.01)

(52) U.S. Cl.
CPC ..... *B66D 1/485* (2013.01); *B66D 1/58* (2013.01); *B66D 2700/025* (2013.01)

(58) Field of Classification Search
CPC . B66D 1/485; B66D 1/56; B66D 1/58; B66D 2700/025; B66D 3/20; B66D 3/24
See application file for complete search history.

(56) References Cited

U.S. PATENT DOCUMENTS 7,354,028 B1 * 4/2008 Kacy ..... B66B 1/32 254/267
8,157,113 B2 * 4/2012 Golder ..... B66D 1/58 212/284
8,328,165 B2 * 12/2012 Eschelbacher ..... B66D 1/12 254/267
2005/0098768 A1 * 5/2005 Malek ..... B66C 15/065 254/267
2019/0016571 A1 * 1/2019 Thirunarayana ..... B66D 1/12

FOREIGN PATENT DOCUMENTS

| | | | |
|---|---|---|---|
| CA | 2930474 | A1 | 5/2015 |
| CN | 104512809 | A | 4/2015 |
| CN | 105800465 | A | 7/2016 |
| JP | H07144883 | A | 6/1995 |

OTHER PUBLICATIONS

First Office Action for related CN 201910248516.0 dated Mar. 24, 2020, with translation, 7 pages.

* cited by examiner

*Primary Examiner* — Emmanuel M Marcelo
(74) *Attorney, Agent, or Firm* — Barnes & Thornburg LLP

(57) ABSTRACT

The present disclosure relates to a control unit for controlling operation of a hoist in a load slip condition. The hoist may include a motor coupled to a winding drum for lifting and lowering a load. The control unit may include a processor and a memory communicatively coupled to the processor. The memory may store processor executable instructions, which, on execution, cause the processor to operate the hoist for selectively lifting and lowering a load between a first position and a second position upon detecting a load slip condition. The processor may operate the hoist based on parameters pertaining to transport of the load. The control unit may be configured to reciprocate the load in a load slip condition to prevent overheating and failure of a motor, thereby preventing a fall of the load in a work area.

10 Claims, 6 Drawing Sheets

CONTROL UNIT FOR CONTROLLING A HOIST IN A LOAD SLIP CONDITION AND METHOD THEREOF

CROSS-REFERENCE TO RELATED APPLICATION

The present application claims priority to Indian Patent Application No. 201841012232, filed Mar. 31, 2018, the entire disclosure of which is incorporated by reference herein.

TECHNICAL FIELD

Present disclosure generally relates to an operation of a hoist. More particularly, but not exclusively, the present disclosure discloses a control unit and a method of controlling operation of the hoist in a load slip condition.

BACKGROUND

Cranes are widely used in handling heavy loads in a number of applications and industries, such as, but not limited to, manufacturing industries, on-shore and off-shore platforms, civil construction sites, and the like. The cranes are configured to handle the heavy loads in a work area by either lifting, lowering, holding or overhanging the heavy loads.

The cranes are provided with a hoist for handling the heavy loads. The hoist generally includes a motor operable by an operator, to lift or lower the load based on requirement. A brake assembly is mounted on a winding drum of the motor, which is adapted to restrict movement of the winding drum, so that the load may be held or supported in an overhang position. However, during prolonged usage of the hoist, or due to overloading, there may be instances that the brake assembly in the overhang condition, may fail, and cause free fall of the heavy load in the work area of the floor.

Conventionally, to overcome such limitations in the brake assembly, a system for compensating brake failure in the brake assembly is employed. The system includes a control unit configured to operate the motor, so that the load falling due to failure of the brake assembly is held in place, until the load is unloaded in a safe zone of the work area. Also, when the load is held at place unattended at zero speed of the motor, the motor might get heated up quickly and burn. In these conditions, the motor may be subjected to undue stresses due to inertial forces and also due to the load acting on the motor. The combination of these stresses may cause the motor to overheat and fail. This condition may lead to loss of power in the motor, and hence the motor may drop the load altogether, which is hazardous and undesirable.

Thus, there exists a need for a control unit for controlling operation of the hoist in the load slip condition in order to maintain a safe work area.

The information disclosed in this background of the disclosure section is only for enhancement of understanding of the general background of the present disclosure and should not be taken as an acknowledgement or any form of suggestion that this information forms the prior art already known to a person skilled in the art.

SUMMARY

The present disclosure relates to a control unit for controlling a hoist in a load slip condition. The hoist comprising a motor coupled to a winding drum, a drive for controlling the motor and a brake assembly adapted to restrict movement of the winding drum. The control unit comprises a processor and a memory communicatively coupled to the processor. The memory stores processor executable instructions, which, on execution, causes the processor to compute a first position of a load based on summation of a zero position of the load and an offset distance of the load, and a second position based on difference between a maximum upper travel distance of the load and the offset distance of the load. The processor then operates the hoist for selectively lifting and lowering the load between the first position and the second position upon detecting the load slip condition. The processor operates the hoist based on parameters pertaining to transport of the load.

In an embodiment, the control unit detects the load slip condition upon receiving a feedback signal from at least one of an encoder, or a toothed wheel assembly coupled to the load, is received by the control unit in an idle condition.

In an embodiment, the control unit computes input data related to the first position, the second position, and the parameters pertaining to transport of the load based on data received from a plurality of sensors provisioned with the hoist surroundings, and stores the input data in the memory, which is required for operating the hoist during load slip condition.

In an embodiment, the parameters pertaining to transport of the load includes at least one of speed of lifting and lowering the load, time required for lifting and lowering the load and combinations thereof.

In an embodiment, the parameters pertaining to transport of the load are predefined in the control unit.

In an embodiment, the control unit is associated with a drive of a crane to control operation of the hoist in the load slip condition.

In another non-limiting embodiment of the present disclosure, a method of operating a hoist in a load slip condition is disclosed. The method comprising receiving, by a control unit a feedback signal from at least one of an encoder or a toothed wheel assembly coupled to a load associated with the hoist. Determining, by the control unit, the load slip condition in the hoist when the control unit receives the feedback signal in an idle condition. Operating, by the control unit, the hoist for selectively lifting and lowering the load between a first position and a second position upon determining the load slip condition, wherein the control unit operates the hoist based on parameters pertaining to transport of the load.

In an embodiment, the control unit overrides mode of operation of the hoist from a manual operational control to an automated operational control upon detecting the load slip condition.

In an embodiment, the control unit automatically operates the hoist, until the user overrides operation of the hoist from the automated operational control to the manual operational control for controlling the hoist.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The accompanying drawings, which are incorporated in and constitute a part of this disclosure, illustrate exemplary embodiments and, together with the description, serve to explain the disclosed principles. In the figures, the left-most digit(s) of a reference number identifies the figure in which the reference number first appears. The same numbers are used throughout the figures to reference like features and components. Some embodiments of system and/or methods in accordance with embodiments of the present subject matter are now described, by way of example only, and about the accompanying figures, in which.

Figure 1:
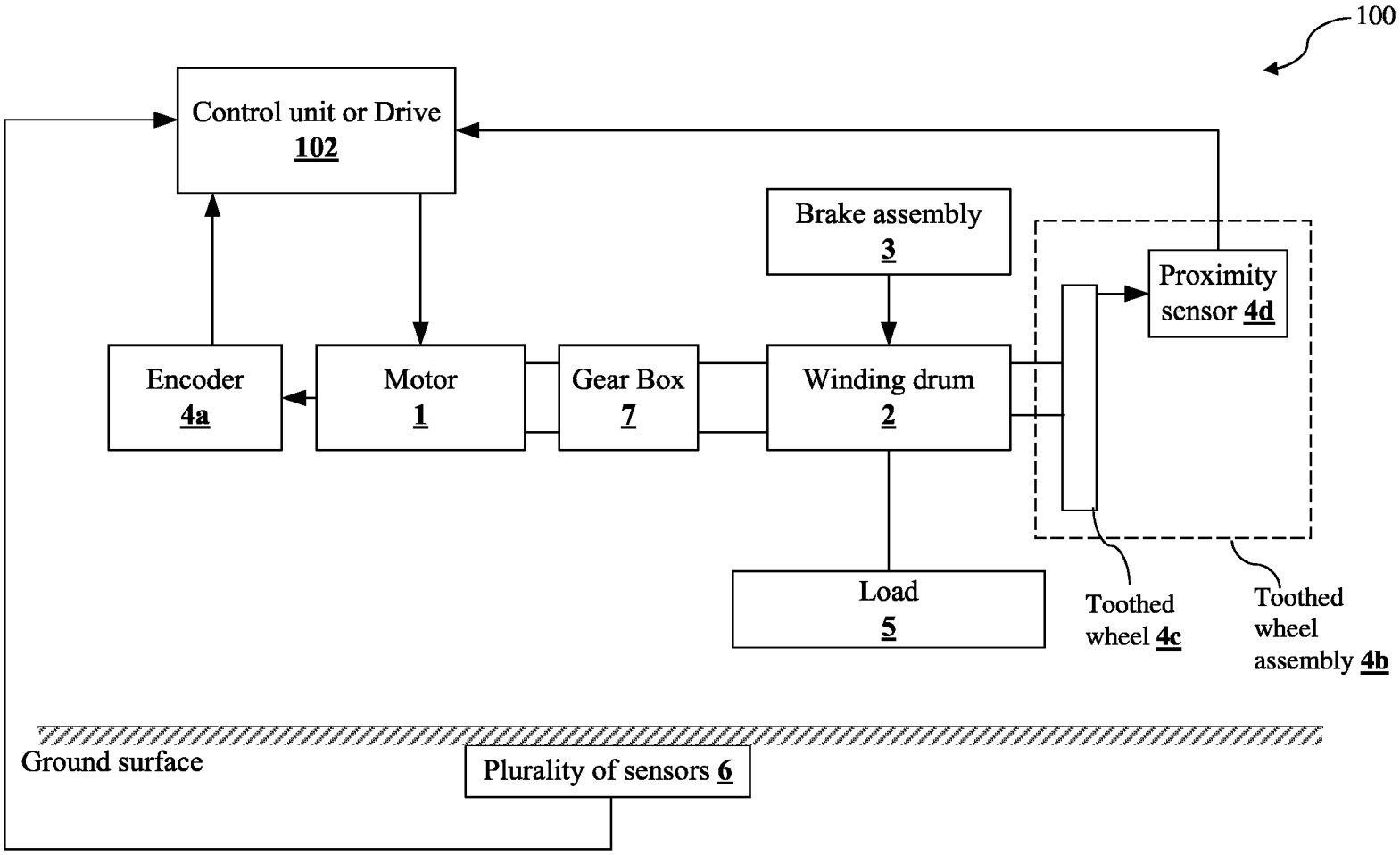
FIG. 1 illustrates an environment for controlling operation of a hoist, in accordance with an embodiment of the present disclosure.

It should be appreciated by those skilled in the art that any block diagrams herein represent conceptual views of illustrative systems embodying the principles of the present subject matter. Similarly, it will be appreciated that any flow charts, flow diagrams, state transition diagrams, pseudo code, and the like represent various processes which may be substantially represented in computer readable medium and executed by a computer or processor, whether or not such computer or processor is explicitly shown.

DETAILED DESCRIPTION OF THE DRAWINGS

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described in detail below. It should be understood, however that it is not intended to limit the disclosure to the particular forms disclosed, but on the contrary, the disclosure is to cover all modifications, equivalents, and alternative falling within the scope of the disclosure.

The terms "comprises", "comprising", or any other variations thereof, are intended to cover a non-exclusive inclusion, such that a setup, device or method that comprises a list of components or steps does not include only those components or steps but may include other components or steps not expressly listed or inherent to such setup or device or method. In other words, one or more elements in a system or apparatus proceeded by "comprises . . . a" does not, without more constraints, preclude the existence of other elements or additional elements in the system or method.

In the following detailed description of the embodiments of the disclosure, reference is made to the accompanying drawings that form a part hereof, and in which are shown by way of illustration specific embodiments in which the disclosure may be practiced. These embodiments are described in sufficient detail to enable those skilled in the art to practice the disclosure, and it is to be understood that other embodiments may be utilized and that changes may be made without departing from the scope of the present disclosure. The following description is, therefore, not to be taken in a limiting sense.

Embodiments of the present disclosure provides a control unit and a method of controlling operation of a hoist, in a load slip condition.

FIG. 1 in one exemplary embodiment of the present disclosure illustrates an environment (100) for controlling operation of a hoist (101). The environment (100) is configured to include various obstacles and emplacements that may be common to any particular industry where the hoist (101) is commissioned for operation. In the present disclosure the hoist (101) is operated for selectively lifting and lowering a load (5) between a first position (FP) and a second position (SP), upon detection of the load slip condition.

The environment (100) comprises the hoist (101) mountable on a crane bridge [not shown in Figures] and configured for hoisting the load (5). The hoist (101) includes a motor (1), which is configured for providing adequate torque to operate the hoist (101). The motor (1) is coupled to a winding drum (2) via a gear box (7), for suitably transferring the torque to the winding drum (2) for hoisting the load (5). A brake assembly (3) may be mounted on the winding drum (2) and is configured to restrict or brake the movement of the winding drum (2) at any specific point during hoisting or according to operator requirements. In an embodiment, as and when the brake assembly (3) restricts or brakes the movement of the winding drum (2), the brake assembly (3) is in an engaged condition.

Figure 2:
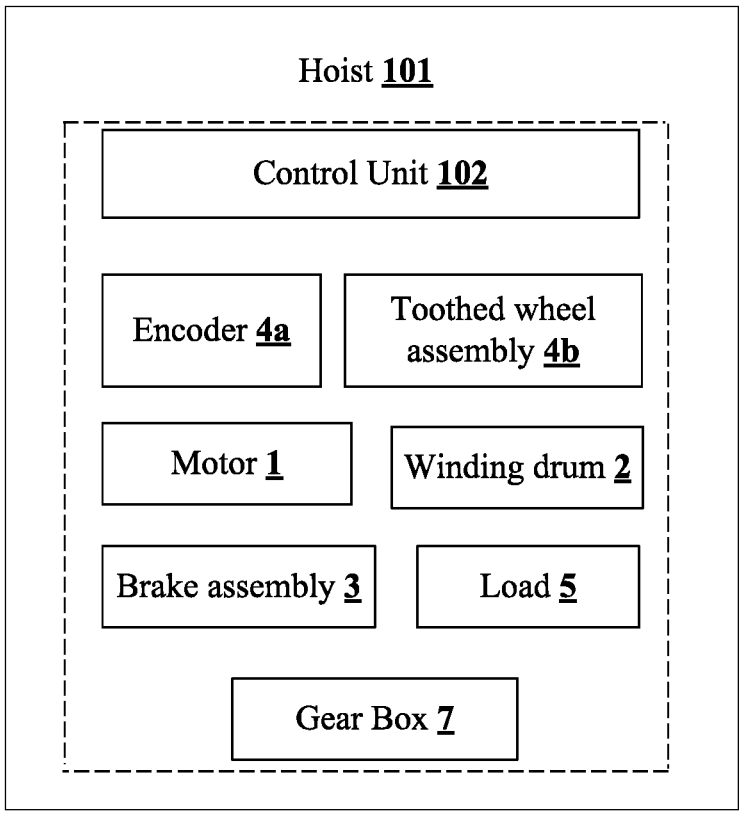
FIG. 2 illustrates a detailed block diagram of the hoist, in accordance with an embodiment of the present disclosure.

Referring to FIG. 2 in conjunction with FIG. 1, the environment (100) further includes an encoder (4*a*), which may be associated with the motor (1). The encoder (4*a*) may be a sensor device configured to sense rotation of the motor (1). The encoder (4*a*) is communicatively connected to the control unit (102) and thus may provide a feedback signal to the control unit (102) continuously, about position data of the motor (1) during operation of the hoist (101). The encoder (4*a*) may also be associated with the load (5), for detecting movement of the load (5). Further, a toothed wheel assembly (4*b*) including a toothed wheel (4*c*) and a proximity sensor (4*d*) may be coupled to the winding drum (2), such that movement of the load (5) in-turn triggers movement of the toothed wheel (4*c*). The proximity sensor (4*d*) may be adapted to sense rotation of the toothed wheel (4*c*), to detect movement of the load (5). The proximity sensor (4*d*) may also be associated with the control unit (102) and thus may provide the feedback signal to the control unit (102) continuously, about movement of the load (5). In an embodiment, the encoder (4*a*) and the toothed wheel assembly (4*b*) may provide the feedback signal continuously to the control unit (102) to provide position data of the motor (1) and about movement of the load (5) respectively. The control unit (102) upon receiving the feedback signal from at least one of the encoder (4*a*) or the toothed wheel assembly (4*b*), detects the load slip condition. Upon detecting the load slip condition, the control unit (102) operates the hoist (101) for selectively lifting and lowering the load (5) between a first position (FP) and a second position (SP) [shown in FIG. 4]. In an embodiment, the control unit (102) receives the feedback signal from at least one of the encoder (4*a*) or the toothed wheel assembly (4*b*), when the control unit (102) is in an idle or stand-by condition.

In an embodiment, the control unit (102) may also be associated with a plurality of sensors (6) provisioned on a ground surface of the hoist (101) surroundings [as shown in FIG. 1]. The plurality of sensors (6) are configured to provide data pertaining to the position of the load (5) being hoisted to the control unit (102), so that the control unit (102) can automatically calculate the data pertaining to the first position (FP) and the second position (SP) of the load (5). Additionally, the plurality of sensors (6) may also indicate and guide the hoist (101) in the surroundings, for unloading the load (5) safely during load slip condition.

In an embodiment, the feedback signal from the encoder (4*a*) or the toothed wheel assembly (4*b*) may be provided to the control unit (102), only when the brake assembly (3) is in the engaged condition.

In an embodiment, at least one of the encoder (4*a*) or the toothed wheel assembly (4*b*) may provide the feedback signal continuously to the control unit (102) to provide position data of the motor (1) and to detect movement of the load (5), when the brake assembly (3) is engaged to the winding drum (2).

In an embodiment, the encoder (4*a*) and the toothed wheel assembly (4*b*) may provide the feedback signal through a wired or a wireless communication means, as per feasibility and requirement.

In an embodiment, the control unit (102) is associated with a drive of a crane, for controlling operation of the hoist (101) in the load slip condition. The drive may be configured to carry out operations of the control unit (102) as per design feasibility and requirement.

In an embodiment, the plurality of sensors (6) may be selected from at least one of positional sensors, load sensors, Program Logic Controllers or any other ground communication network devices which serves the requirement.

In an embodiment, the winding drum (2) may include one or more limit switches [not shown in Figures] for governing movement of the load (5), in the load slip condition. The one or more limit switches act as a safety interlock, for controlling movement of the load (5) in the load slip condition. In an embodiment, the one or more limit switches is selected from at least one of a mechanical limit switch, an electromechanical limit switch and the like, which serves the requirement.

Figure 3:
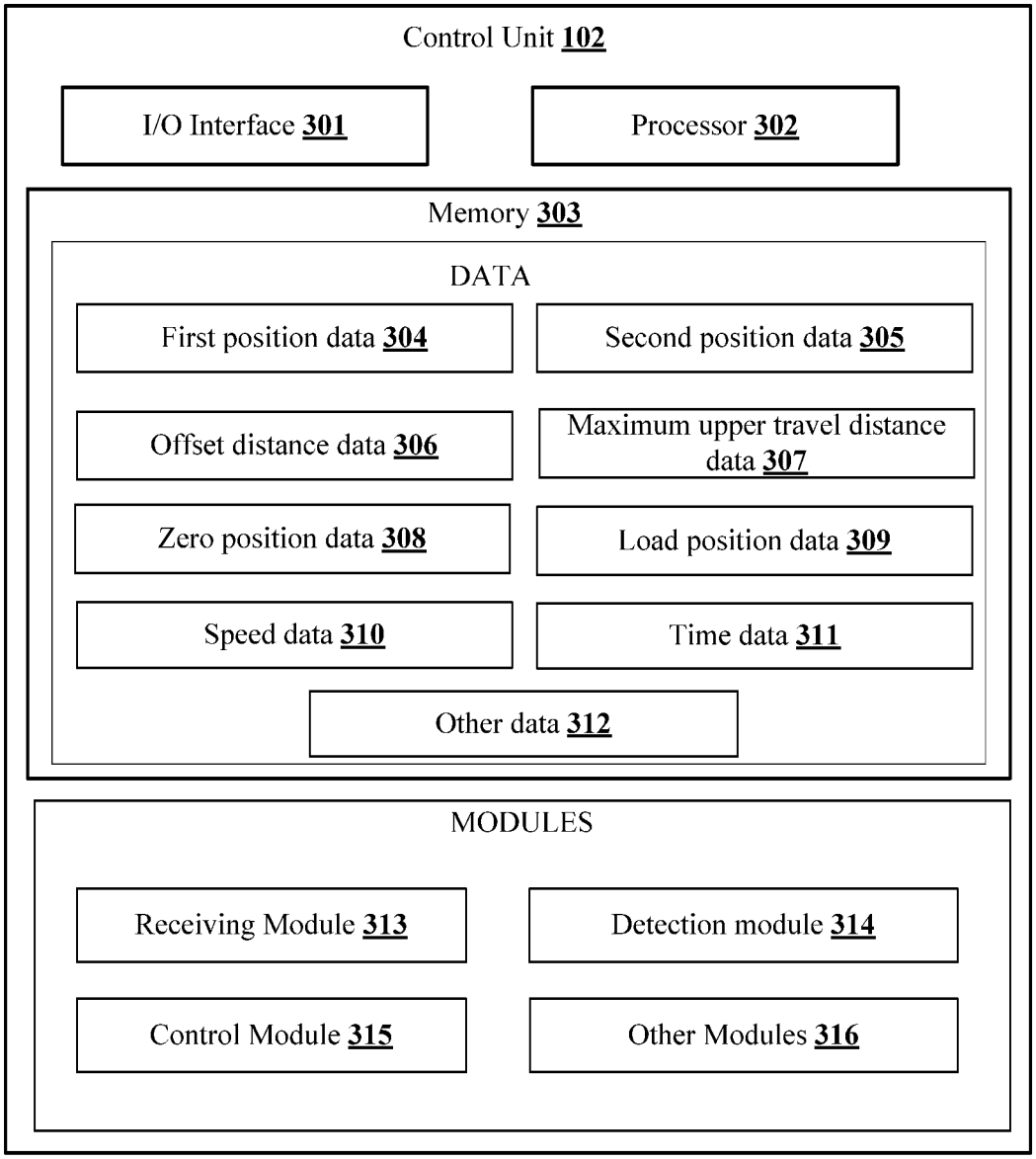
FIG. 3 illustrates a detailed block diagram of a control unit for controlling operation of the hoist, in accordance with an embodiment of the present disclosure.

FIG. 3 in one exemplary embodiment of the present disclosure illustrates a block diagram of the control unit (102) for controlling operation of the hoist (101). The control unit (102) comprises an I/O interface (301), a processor (302) and a memory (303). The memory (303) is communicatively coupled to the processor (302). The processor (302) is configured to perform one or more functions of the control unit (102) for controlling operation of the hoist (101) in the load slip condition. In one implementation, the control unit (102) comprises data and modules for performing various operations in accordance with the embodiments of the present disclosure. In an embodiment, the data may include, without limiting to, first position data (304), second position data (305), offset distance data (306), maximum upper travel distance data (307), zero position data (308), load position data (309), speed data (310), time data (311) and other data (312).

In an embodiment, the control unit (102) may comprise a controller instead of the processor (302) for performing the functionalities of the control unit (102) in controlling operation of the hoist (101).

In one embodiment, the data may be stored within the memory (303) in the form of various data structures. Additionally, the aforementioned data can be organized using data models, such as relational or hierarchical data models. The other data (306) may store data, including temporary data and temporary files, generated by modules for performing the various functions of the control unit (102).

In an embodiment, the data may be processed by one or more modules. In one implementation, the one or more modules may also be stored as a part of the processor (302). In an example, the one or more modules may be communicatively coupled to the processor (302) for performing one or more functions of the control unit (102).

In one implementation, the one or more modules may include, without limiting to, receiving module (313), detection module (314), control module (315) and other modules (316).

As used herein, the term module refers to an application specific integrated circuit (ASIC), an electronic circuit, a processor (shared, dedicated, or group) and memory that execute one or more software or firmware programs, a combinational logic circuit, and/or other suitable components that provide the described functionality.

In an embodiment, the receiving module (313) configured in the control unit (102) may receive the load position data (309) from at least one of the encoder (4*a*) or the toothed wheel assembly (4*b*) through the I/O Interface (301). The load position data (309) in the form of feedback signal from at least one of the encoder (4*a*) or the toothed wheel assembly (4*b*), detects the load slip condition in the hoist (101), when transmitted to the processor (302). The receiving module (313) may also receive data from the proximity sensor (4*d*), located proximal to the load (5) for detecting movement of the load (5). The data from the proximity sensor (4*d*) located proximal to the load (5) may be embedded in the data (304) from at least one of the encoder (4*a*) or the toothed wheel assembly (4*b*), by the receiving module (313).

In an embodiment, the receiving module (313) configured in the control unit (102) may receive the first position data (304) and the second position data (305) from the user through the I/O Interface (301). The first position data (304) and the second position data (305), indicates the first position (FP) and the second position (SP), so that the control unit (102) can operate the hoist (101) for selectively lifting and lowering of the load (5) between the first position (FP) and the second position (SP), when requirement arises. The receiving module (313) may also receive the offset distance data (306), the maximum upper travel distance data (307) and the zero position data (308), so that the control unit (102) may determine the first position data (304) and the second position data (305).

In an embodiment, the receiving module (313) configured in the control unit (102) may receive the speed data (310) from the user through the I/O interface (301). The speed data (310) indicates to the control unit (102) the speed at which the load (5) is to be displaced, during selective lifting and lowering of the load (5) between the first position (FP) and the second position (SP).

In an embodiment, the receiving module (313) configured in the control unit (102) may receive the time data (311) from the user through the I/O interface (301). The time data (311) indicates to the control unit (102) the time period at which the load (5) is to be displaced, during selective lifting and lowering of the load (5) between the first position (FP) and the second position (SP).

In an embodiment, the detection module (308) may detect movement of the load (5), based on the feedback signal or the data (304) from at least one of the encoder (4*a*) or the toothed wheel assembly (4*b*). The detection module (308) may generate a control signal upon detection of the movement of the load (5). The data received and generated in the detection module (308) is stored in the memory (303).

In an embodiment, the control module (309) may be configured to control operation of the hoist (101) upon detection of the load slip condition by the detection module (308). The control module (309) may be configured to operate the hoist (101) for selectively lifting and lowering the load (5) between the first position (FP) and the second position (SP). Thus, upon detection of the load slip condition, the hoist (101) is operated by the control module (309) to reciprocate the load (5) between the first position (FP) and the second position (SP).

In an embodiment, the control module (309) operates the hoist (101) based on parameters pertaining to transport of the load (5) which are predefined in the control unit (102). The parameters pertaining to transport of the load (5) include at least one of speed of lifting and lowering the load (5), time required for lifting and lowering the load (5) and combinations thereof. In an exemplary embodiment, the control module (309) may operate the hoist (101) for selectively lifting and lowering the load (5) between the first position (FP) and the second position (SP) at a speed of about 0.1 ft./sec. That is, the control module (309) operates the hoist (101) such that, the speed of the load (5) to reciprocate between the first position (FP) and the second position (SP) would be about 0.1 ft./sec.

In another exemplary embodiment, the control module (309) may operate the hoist (101) for selectively lifting and lowering the load (5) between the first position (FP) and the second position (SP) in a time period of about 10 mins/ft. That is, the control module (309) operates the hoist (101) such that, the time taken for the load (5) to displace one feet distance is about 10 mins In another exemplary embodiment, the control module (309) may operate the hoist (101) for selectively lifting and lowering the load (5) between the first position (FP) and the second position (SP) for a predetermined time period of about 1 hour at a predetermined speed of about 0.1 ft./sec. That is, the control module (309) may operate the hoist (101) such that, the load (5) reciprocates between the first position (FP) and the second position (SP) for about 1 hour at the speed of about 0.1 ft/sec.

Figure 4:
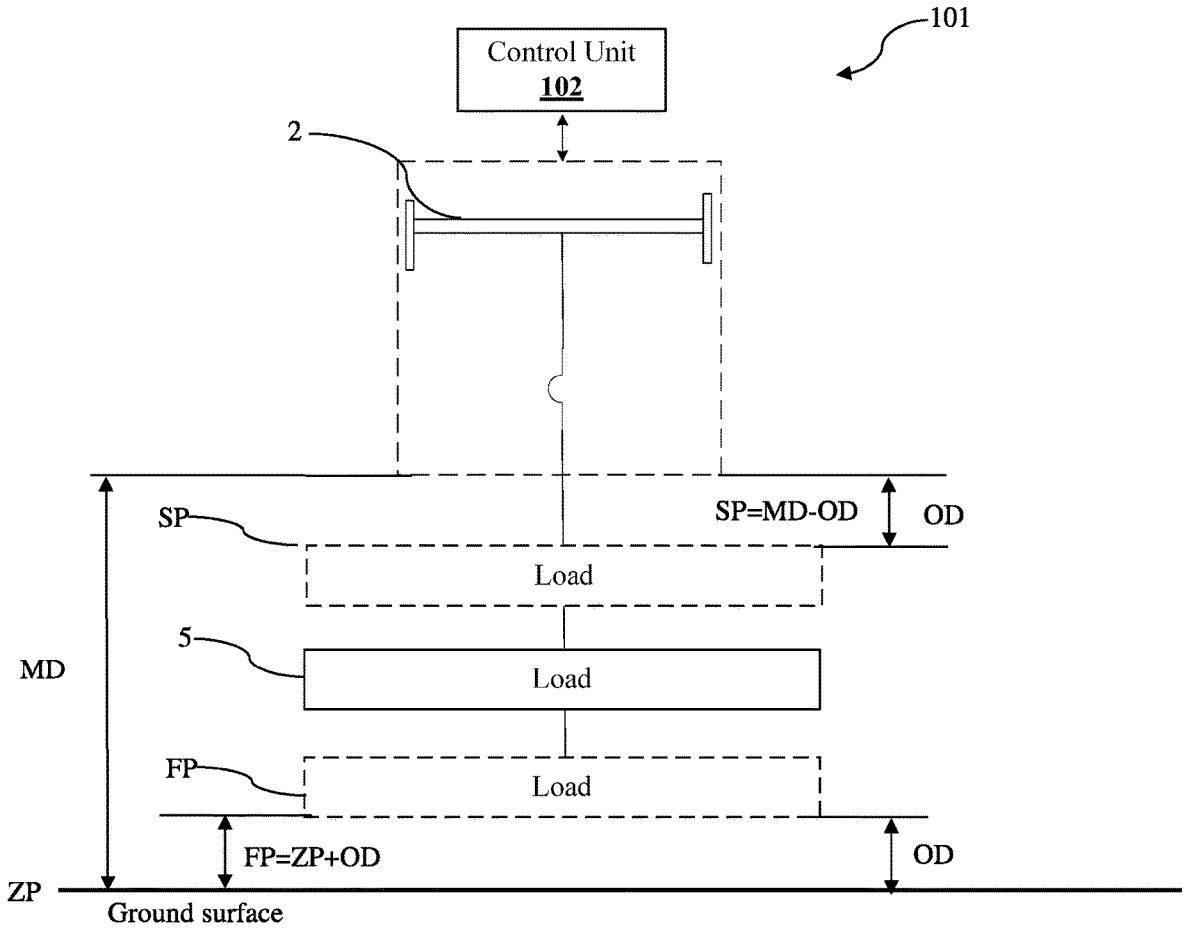
FIG. 4 illustrates a schematic view of operation of the hoist of FIG. 1.

FIG. 4 in one exemplary embodiment of the present disclosure illustrates operation of the hoist (101) by the control unit (102) in the load slip condition.

During normal operating conditions, the hoist (101) is manually operated by the user for carrying out crane specific operations i.e. to hoist and to transport the load within the hoist (101) surroundings. Once, the load slip is detected in the hoist (101), which may be due to failure in the brake assembly (3), the encoder (4*a*) or the toothed wheel assembly (4*b*) may provide the feedback signal to the control unit (102). Upon receiving the feedback signal from either of the encoder (4*a*) or the toothed wheel assembly (4*b*), the control unit (102) takes control of operation of the hoist (101) for selectively lifting and lowering the load (5) between the first position (FP) and the second position (SP). That is, the control unit (102) overrides a manual operational control of the user to an automatic operational control for lifting and lowering the load (5). In an embodiment, the user may override the automatic operational control of the control unit (102) to the manual operational control, for lifting and lowering the load (5) as per feasibility and requirement.

Further, for lifting and lowering the load (5), data pertaining to the first position (FP) and the second position (SP) may be provided to the control unit (102) by the user. The data pertaining to the first position (FP) and the second position (SP) may also be automatically computed by the control unit (102), based on the data received from the plurality of sensors (6) provisioned on the ground surface of the hoist (101) surroundings. In an embodiment, the data pertaining to the first position (FP) and the second position (SP) may be considered such that, the load (5) does not collide with any of the equipment or machinery during reciprocal movement between the first position (FP) and the second position (SP) or while maneuvering the load (5) to a safe location. In an exemplary embodiment, if the hoist (101) is holding the load (5) at about 50 ft. from the ground surface, and one of the equipment is located at about 10 ft. from the ground surface, the first position (FP) may be provided at about 15 ft., while the second position (SP) may be provided at about 85 ft. Thus, in this case, the offset distance (OD) which may be the distance between the first position (FP) and the second position (SP) is about 70 ft.

In an embodiment, the first position (FP) may also be derived based on Eq. 1 as given below:

$$\text{First position (FP)} = \text{Maximum upper travel distance (MD)} + \text{Offset distance (OD)} \quad \text{(Eq. 1).}$$

That is, if the maximum upper travel distance (MD) of the load (5) is about 100 ft. and the offset distance (OD) is set at about 50 ft., then the first position (FP) would be at 50 ft.

In an embodiment, the second position (SP) may also be derived based on Eq. 2 as given below:

$$\text{Second position (SP)} = \text{zero position [home switch] (ZP)} + \text{Offset distance (OD)} \quad \text{(Eq. 2).}$$

That is, if the zero position is at about 0 ft. and the offset distance (OD) is set at about 50 ft., then the second position (SP) would be at 50 ft.

In an embodiment, the computations using the equations of the first position (FP) and the second position (SP) may be carried out by the control unit (102) automatically, based on the data received from the plurality of sensors (6).

Upon receiving the data pertaining to the first position (FP) and the second position (SP) of the load (5), the control unit (102) operates hoist (101) based on the parameters pertaining to transport of the load (5) [pre-defined parameters in the control unit (102)] until the load (5) is dropped at a safe location. That is, hoist (101) lifts or lowers the load (5) between the first position (FP) and the second position (SP), based on at least one of speed of lifting and lowering the load (5) and time required for lifting and lowering the load (5).

Figure 5:
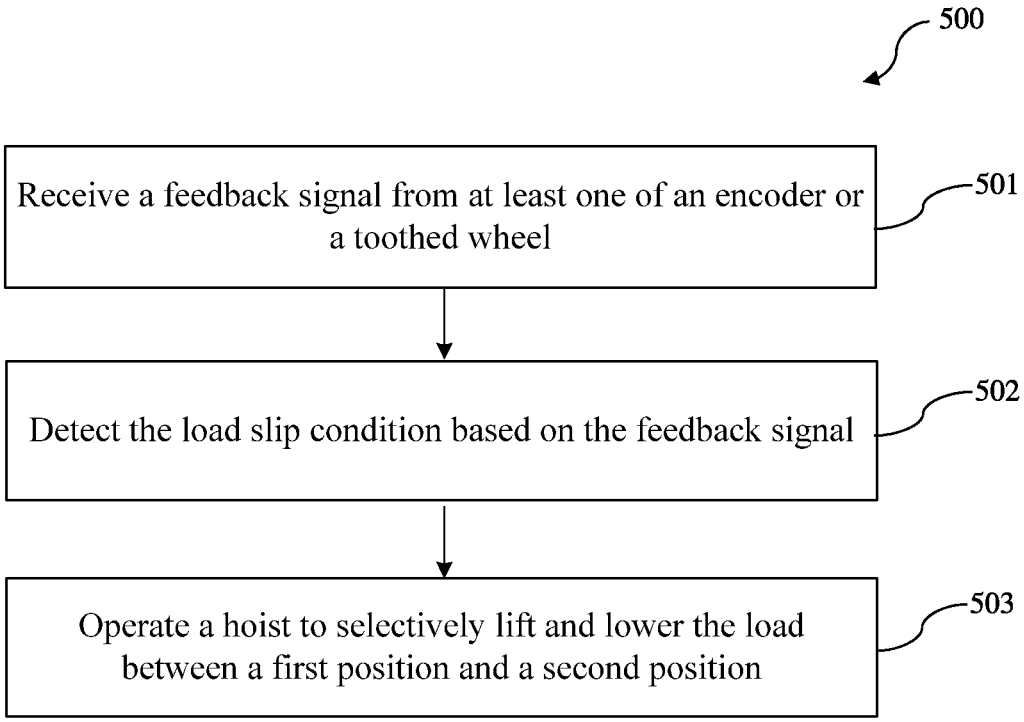
FIG. 5 illustrates a flow chart for controlling operation of the hoist, in accordance with some embodiments of the present disclosure.

FIG. 5 in one exemplary embodiment of the present disclosure illustrates a flowchart of a method of controlling operation of the hoist (101).

As illustrated in FIG. 5, the method comprises one or more blocks for controlling operation of the hoist (101) in the load slip condition. The method may be described in the general context of computer executable instructions. Generally, computer executable instructions can include routines, programs, objects, components, data structures, procedures, modules, and functions, which perform particular functions or implement particular abstract data types.

The order in which the method (500) is described is not intended to be construed as a limitation, and any number of the described method blocks can be combined in any order to implement the method. Additionally, individual blocks may be deleted from the methods without departing from the scope of the subject matter described herein. Furthermore, the method (500) can be implemented in any suitable hardware, software, firmware, or combination thereof.

At block (501), initially, the control unit (102) operates the winding drum (2) to lift the load (5) at a required position. The brake assembly (3) is subsequently operated to the engaged position, to hold the position of the load (5). In this condition, the at least one of the encoder (4*a*) or toothed wheel assembly (4*b*) monitors the position of the load (5). In the event, the position of the load (5) alters which may be due to failure of the brake assembly (3) or overloading, the at least one of the encoder (4*a*) or the toothed wheel assembly (4*b*) may provide the feedback signal to the control unit (102). In an embodiment, the feedback signal from the at least one of the encoder (4*a*) or the toothed wheel assembly (4*b*) may be provided to the drive associated with the control unit (102).

At block (502), the control unit (102) in the idle condition receives the feedback signal from the at least one of the encoder (4*a*) or the toothed wheel assembly (4*b*). The control unit (102) based on the feedback signal, detects movement of the load (5) even when the engaged condition of the brake assembly (3), which may be due to failure of the brake assembly (3) or overloading and thereby indicate the load slip condition.

Subsequently, at block (503) the control unit (102) operates the hoist (101) to selectively lift and lower the load (5) between the first position (FP) and the second position (SP). In this condition, the control unit (102) overrides manual operational control of the user to the automated operational control, for selectively lifting and lowering the load (5). The control unit (102) may operate compute required values, based on the data received from the plurality of sensors (6) provided on the ground surface of the hoist (101) surroundings. In an embodiment, the control unit (102) may operate automatically based on input received from the user.

The control unit (102) may continue to operate in an automated operational control, until the user overrides the automated operational control to a manual operational control. The user then may drop the load (5) at the safe location in the work area. In an embodiment, the control unit (102) operates in the automated operational control mode until the load is dropped at the safe location in the work area.

Figure 6:
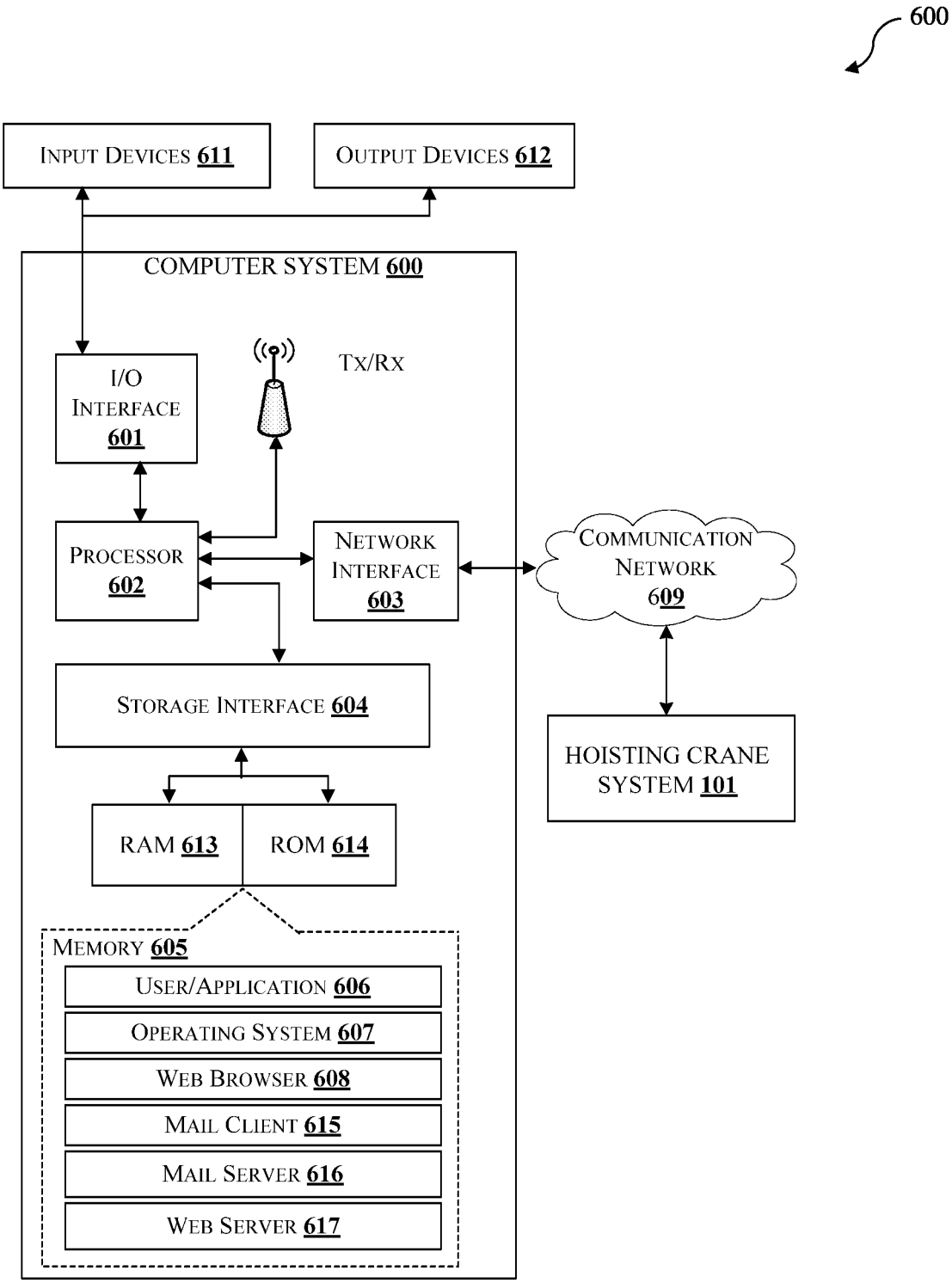
FIG. 6 illustrates a block diagram of an exemplary computer system for implementing embodiments consistent with the present disclosure.

FIG. 6 in one exemplary embodiment of the present disclosure illustrates a block diagram of a computer system (600) for implementing embodiments consistent with the present disclosure. In an embodiment, the computer system (600) can be the control unit (102) configured for controlling operation of the hoist (101) in the load slip condition. The computer system (600) may comprise a central processing unit ("CPU" or "processor") 602. The processor (602) may comprise at least one data processor for executing program components for executing user- or system-generated processes. The processor (602) may include specialized processing units such as integrated system (bus) controllers, memory management control units, floating point units, graphics processing units, digital signal processing units, etc.

The processor (602) may be disposed in communication with one or more input/output (I/O) devices (611 and 612) via an I/O interface (601). The I/O interface (601) may employ communication protocols/methods such as, without limitation, audio, analog, digital, stereo, IEEE-1394, serial bus, Universal Serial Bus (USB), infrared, PS/2, BNC, coaxial, component, composite, Digital Visual Interface (DVI), high-definition multimedia interface (HDMI), Radio Frequency (RF) antennas, S-Video, Video Graphics Array (VGA), IEEE 802.n/b/g/n/x, Bluetooth, cellular (e.g., Code-Division Multiple Access (CDMA), High-Speed Packet Access (HSPA+), Global System For Mobile Communications (GSM), Long-Term Evolution (LTE) or the like), etc.

Using the I/O interface (601), the computer system (600) may communicate with the one or more I/O devices (611 and 612).

In an embodiment, the processor (602) may be disposed in communication with a communication network (609) via a network interface (603). The network interface (603) may communicate with the communication network (609). The network interface (603) may employ connection protocols including, without limitation, direct connect, Ethernet (e.g., twisted pair 10/100/1000 Base T), Transmission Control Protocol/Internet Protocol (TCP/IP), token ring, IEEE 802.11a/b/g/n/x, etc. The communication network (609) can be implemented as one of the different types of networks, such as intranet or Local Area Network (LAN) and such within the organization. The communication network (609) may either be a dedicated network or a shared network, which represents an association of the different types of networks that use a variety of protocols, for example, Hypertext Transfer Protocol (HTTP), Transmission Control Protocol/Internet Protocol (TCP/IP), Wireless Application Protocol (WAP), etc., to communicate with each other. Further, the communication network (609) may include a variety of network devices, including routers, bridges, servers, computing devices, storage devices, etc.

In an embodiment, the processor (602) may be disposed in communication with a memory (605) (e.g., RAM 513, ROM 514, etc.) via a storage interface (604). The storage interface (604) may connect to memory (605) including, without limitation, memory drives, removable disc drives, etc., employing connection protocols such as Serial Advanced Technology Attachment (SATA), Integrated Drive Electronics (IDE), IEEE-1394, Universal Serial Bus (USB), fiber channel, Small Computer Systems Interface (SCSI), etc. The memory drives may further include a drum, magnetic disc drive, magneto-optical drive, optical drive, Redundant Array of Independent Discs (RAID), solid-state memory devices, solid-state drives, etc.

The memory (605) may store a collection of program or database components, including, without limitation, user/application data (606), an operating system (607), web browser (608) etc. In some embodiments, computer system (600) may store user/application data (606), such as the data, variables, records, etc. as described in this disclosure. Such databases may be implemented as fault-tolerant, relational, scalable, secure databases such as Oracle or Sybase.

Furthermore, one or more computer-readable storage media may be utilized in implementing embodiments consistent with the present disclosure. A computer-readable storage medium refers to any type of physical memory on which information or data readable by a processor may be stored. Thus, a computer-readable storage medium may store instructions for execution by one or more processors, including instructions for causing the processor(s) to perform steps or stages consistent with the embodiments described herein. The term "computer-readable medium" should be understood to include tangible items and exclude carrier waves and transient signals, i.e., non-transitory. Examples include Random Access Memory (RAM), Read-Only Memory (ROM), volatile memory, nonvolatile memory, hard drives, Compact Disc (CD) ROMs, Digital Video Disc (DVDs), flash drives, disks, and any other known physical storage media.

In an embodiment, the present disclosure attenuates load acting on the motor during the load slip condition by reciprocating the load between the first position and the second position, thereby preventing overheating and failure of the motor.

In an embodiment, the present disclosure automatically takes control of operation of the hoist, to prevent uncontrolled fall of the load within the work area, thereby rendering a safe work area.

The terms "an embodiment", "embodiment", "embodiments", "the embodiment", "the embodiments", "one or more embodiments", "some embodiments", and "one embodiment" mean "one or more (but not all) embodiments" unless expressly specified otherwise.

The terms "including", "comprising", "having" and variations thereof mean "including but not limited to", unless expressly specified otherwise.

The enumerated listing of items does not imply that any or all of the items are mutually exclusive, unless expressly specified otherwise.

The terms "a", "an" and "the" mean "one or more", unless expressly specified otherwise.

A description of an embodiment with several components in communication with each other does not imply that all such components are required. On the contrary a variety of optional components are described to illustrate the wide variety of possible embodiments of the disclosure.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article or a different number of devices/articles may be used instead of the shown number of devices or programs. The functionality and/or the features of a device may be alternatively embodied by one or more other devices which are not explicitly described as having such functionality/features. Thus, other embodiments of the disclosure need not include the device itself.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based here on. Accordingly, the embodiments of the present disclosure are intended to be illustrative, but not limiting, of the scope of the disclosure, which is set forth in the following claims.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A control unit for controlling a hoist in a load slip condition, wherein the hoist comprises a motor coupled to a winding drum, a drive for controlling the motor, and a brake assembly adapted to restrict movement of the winding drum, the control unit comprising:

a processor; and a memory communicatively coupled to the processor, wherein the memory stores processor-executable instructions, which, on execution, cause the processor to:

compute a first position of a load based on summation of a zero position of the load and an offset distance of the load, and a second position based on a difference between a maximum upper travel distance of the load and the offset distance of the load; and operate the hoist for selectively lifting and lowering the load between the first position and the second position upon detecting the load slip condition, wherein the processor operates the hoist based on parameters pertaining to transport of the load.

2. The control unit of claim 1, wherein the processor-executable instructions, on execution, cause the processor to detect the load slip condition when a feedback signal from at least one of an encoder and a toothed wheel assembly coupled to the load is received by the control unit in an idle condition.

3. The control unit of claim 1, wherein the processor-executable instructions, on execution, cause the processor to (i) compute input data related to the first position, the second position, and the parameters pertaining to transport of the load based on data received from a plurality of sensors provisioned with the hoist surroundings and (ii) store the input data in the memory for operating the hoist during the load slip condition.

4. The control unit of claim 1, wherein the parameters pertaining to transport of the load include at least one of speed of lifting and lowering the load, time required for lifting and lowering the load, and combinations thereof.

5. The control unit of claim 1, wherein the parameters pertaining to transport of the load are predefined in the control unit.

6. The control unit of claim 1, wherein the control unit is associated with a drive of a crane to control operation of the hoist in the load slip condition.

7. A method of operating a hoist in a load slip condition, comprising:

receiving, by a control unit, a feedback signal from at least one of an encoder and a toothed wheel assembly coupled to a load associated with the hoist;

determining, by the control unit, the load slip condition in the hoist when the control unit receives the feedback signal in an idle condition; and operating, by the control unit, the hoist for selectively lifting and lowering the load between a first position and a second position upon determining the load slip condition, wherein the control unit operates the hoist based on parameters pertaining to movement of the load.

8. The method of claim 7, wherein the control unit receives input data related to the first position, the second position, and the parameters pertaining to movement of the load by a user.

9. The method of claim 7, further comprising overriding, by the control unit, a mode of operation of the hoist from a manual operational control to an automated operational control upon detecting the load slip condition.

10. The method of claim 9, further comprising operating the hoist automatically, by the control unit, until a user overrides the operation of the hoist from the automated operational control to the manual operational control for controlling the hoist.

* * * * *